United States Patent [19]

Reichmann

[11] 4,044,726

[45] Aug. 30, 1977

[54] CIRCULATING WATER HEATER

[75] Inventor: Horst Reichmann, Wuppertal, Germany

[73] Assignee: Joh. Vaillant K.G., Remscheid, Germany

[21] Appl. No.: 643,869

[22] Filed: Dec. 23, 1975

[30] Foreign Application Priority Data

Dec. 13, 1975 Germany ..... 7540065[U]

[51] Int. Cl.[2] ..... F22B 1/02; F22B 7/06; F22B 37/10

[52] U.S. Cl. ..... 122/33; 122/145; 122/367 C

[58] Field of Search ..... 122/140, 145, 33, 32, 122/367 R, 367 C

[56] References Cited

U.S. PATENT DOCUMENTS

| | | | |
|---|---|---|---|
| 2,683,442 | 7/1954 | Karlen | 122/33 |
| 2,736,298 | 2/1956 | Smith | 122/145 |
| 3,213,832 | 10/1965 | Jakobsson | 122/33 |
| 3,315,645 | 4/1967 | Linnersten | 122/33 |
| 3,366,092 | 1/1968 | Bove | 122/33 |
| 3,685,496 | 4/1972 | Stiefel | 122/140 |

*Primary Examiner*—Kenneth W. Sprague
*Attorney, Agent, or Firm*—Toren, McGeady and Stanger

[57] ABSTRACT

A forced circulation heater equipped with a blower burner is provided with a horizontally extending exhaust gas duct and with a heat exchanger disposed within the exhaust gas duct. The heat exchanger is constructed as a plate block and includes upright water tubes. A storage vessel is disposed above the heat exchanger and heating system header connections and return connections extend directly into the storage vessel. The heat exchanger together with its upright water tubes is incorporated into the horizontally extending exhaust duct to extend over the entire cross section thereof with the tubes of the heat exchanger being connected to the storage vessel.

5 Claims, 3 Drawing Figures

CIRCULATING WATER HEATER

Figure 1:
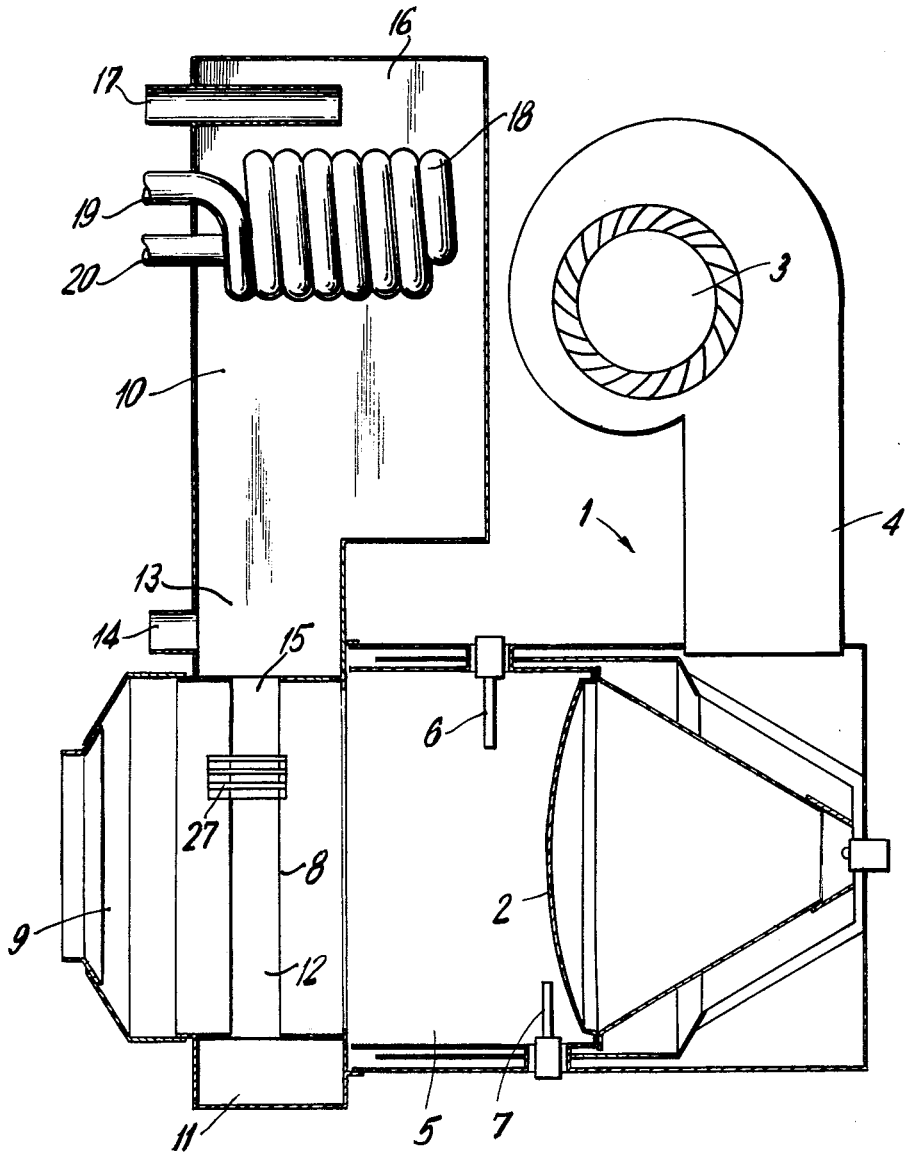

The present invention relates to a forced-circulation water heater.

This kind of arrangement of a forced-circulation water heater has been disclosed in the German Offenlegungsschrift No. 21 15 531 in which the burner is constructed as a so-called oil vaporization burner. The exhaust gas shaft is arranged substantially perpendicularly and the heat exchanger is constructed as a plate block with horizontally disposed water tubes.

In the practical operation of this device it has been found that the thermal capacity of the forced-circulation water heater is too small in relation to the adjoining water circuit so that the forced-circulation water heater comes into action too frequently, operates with insufficient temperature on the plate block, features which result in the plate block becoming rapidly clogged with combustion residue. In cases in which the combustion air is electrically preheated this will result in a very high consumption of electrical energy.

It is therefore the object of the present invention to provide a forced-circulation water heater of the kind described hereinbefore in which clogging of the plate block is avoided and in which the heat exchanger does not produce heat residue when the burner is shut down.

This problem is solved in a forced-circulation water heater by the features provided in accordance with the present invention. The substantial advantage is to be seen in the thermo-siphon action which occurs when the forced-draught burner is shut down. The water, heated to high temperatures in the tubes of the plate block, is able to flow freely upwardly into the storage vessel, cool water being drawn downwardly to cool the heat exchanger which is heated to high temperatures. The volumetric capacity of the storage vessel can be readily matched to the heat exchanger so that clogging of the plate block and brief operating intervals of the burner can be avoided. The electric power consumption is substantially reduced.

Figure 2:
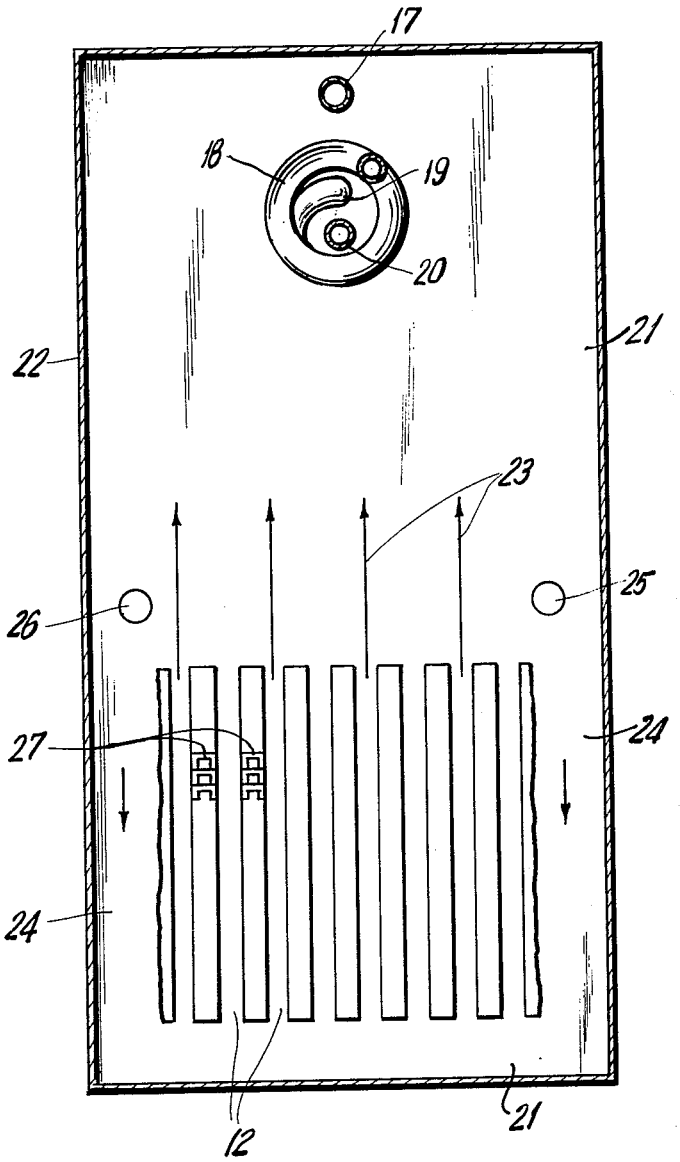
Figure 3:
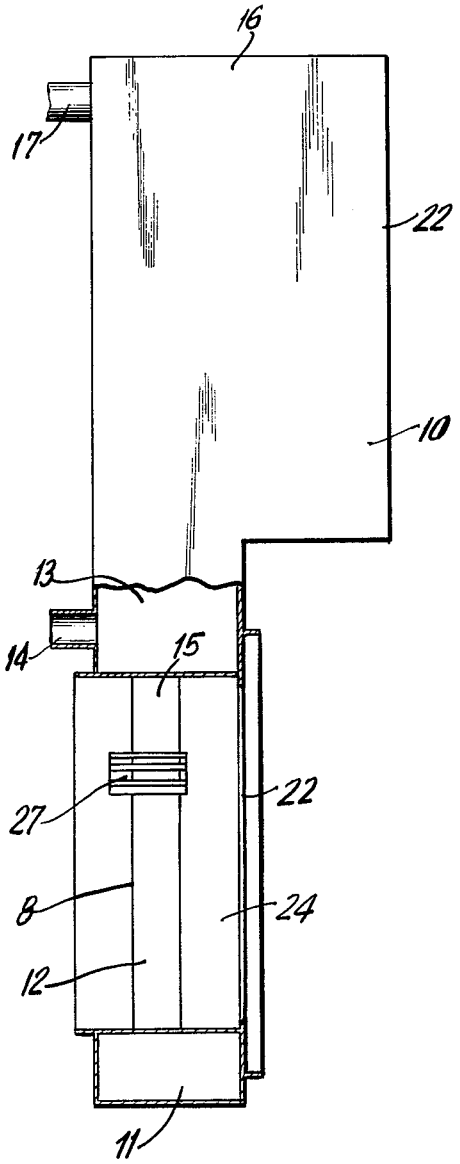

Further embodiments and developments according to the invention are disclosed in the description hereinbelow and FIGS. 1 to 3 of the drawing which shows embodiments of the invention and in which:

FIG. 1 is a basic diagram of the forced-circulation water heater in partial section and as a side view, FIG. 2 is a section through the heat exchanger with the storage vessel when viewing the burner and FIG. 3 is another side view in another embodiment.

Identical reference symbols in all three illlustrations refer to the same details.

The forced-circulation water heater according to FIG. 1 is provided with an oil vaporization burner 2 to which fresh air is supplied by a blower 3 through a shaft 4. The burner 2 adjoins an exhaust gas duct 5, having disposed therein an ionization monitoring electrode 6 and an ignition device 7 for the burner. A plate block heat exchanger 8 is provided in the horizontally extending gas duct 5 before this converges into an exit port 9. A storage vessel 10 is directly mounted on the heat exchanger 8. A by-pass duct 11 is provided below the heat exchanger. The storage vessel 10 and the by-pass duct 11 communicate on the water side on the one hand through a plurality of parallel-connected water tubes 12 and on the other hand via the by-pass duct 11 which extends upwardly in the support frame in the form of external ducts 24. The bottom region 13 of the storage vessel 11 extends into a heating return connection 14 the location of which is therefore directly adjacent to the header connection 15 of the heat exchanger 8.

The heating header 17, the tube of which extends approximately to the middle of the storage vessel 10, is situated in the upper region 16 of the said storage vessel. An industrial water heat exchanger 38, the header line of which is designated with the numeral 19 and the return line of which is designated with the numeral 20, is arranged in the middle region of the storage vessel 10. The bottom region 13 of the storage vessel is narrower than the top range 16 to assist the thermo-siphon action of the storage vessel 10 in the region of the heat exchanger 8.

As may be seen by reference to FIG. 2, the heat exchanger 8 together with the storage vessel 10 forms a structural module 21, comprising a support frame 22 adapted to accommodate the heat exchanger 18 and the storage vessel 10.

The individual parallel-connected tubes 12, in which the water flows upwardly in the direction of the arrows 23, can be seen in the bottom part. The water flows downwardly in the outer ducts 24. The outer ducts 24 must be regarded as part of the by-pass duct 11. The construction of the forced-circulation water heater in the embodiment according to FIG. 2 is modified in the sense that the heating return connection 14 is divided into two parallel-connected connection members 25 and 26 so that the relatively cold heating return water arriving at that position immediately drops under the action of gravity into the outer ducts 24.

If only a single connecting member 14 is provided it will be situated in the region of the median plane, i.e. directly above the middle heat exchanger water tube 12. This feature provides the advantage that the header water from the heat exchanger 8 has the highest temperature and rises at that position and is most intensively cooled to result in a relatively good mixing temperature of the header water.

The construction in FIG. 3 is modified in the sense that the industrial water heat exchanger 18 is removed from the storage vessel 10 and is installed at another place. The industrial water heat exchanger 18 is then connected via the connectors 14 and 17 to the storage vessel 10; the incorporation of a priority branch for separating the circulating water from the heating circuit if industrial water is to be tapped off then becomes necessary. FIG. 3 also discloses that the outer ducts 24 are incorporated into the supporting frame 22 and have a longitudinal extension which is longer than that of the actual heat exchanger 8, the plates 27 of which however extend beyond the longitudinal extension of the heat exchanger 8. The longitudinal extension of the plate is however less than that of the support frame 22.

The individual plates 27 together with the plurality of tubes 12 form the actual plate block heat exchanger 8.

The arrangement according to the invention functions as follows:

If heat is required by a thermostat, not shown, either on the header side, industrial water side and/or room thermostat side, the blower 3 will be set into operation to deliver fresh air through the duct 4 to the oil vaporization burner 2. The burner is electrically pre-heated and ignited by the electrode 7 and delivers hot exhaust gas into the exhaust gas duct 5 so that the exhaust gas is pumped through the entire cross-section of the heat exchanger 8 which fills the exhaust gas duct 5. The plates 27 and the tubes 12 of the heat exchanger 8 are therefore heated before the exhaust gas is discharged through the discharge port 9. The water in the tubes 12 is heated and rises as the result of thermosiphon action via the header ports 15 into the bottom region of the storage vessel 10. As the result of thermo-siphon action the water then passes finally into the upper region 16 of the storage vessel 10. Due to the rising of the water, cooler water is drawn either from the return connection 14 or from the return connections 25 and 26 of the heating system or from the bottom region 13 of the storage vessel 10 via the outer ducts 24 into the by-pass duct 11 and from there passes into the heat exchanger 8 where it is heated. If the burner 2 is therefore in operation, the water in the storage vessel 10 is constantly exchanged without the need for a pump. The entire water contents of the heat exchanger 8 and of the storage vessel 10 are heated in a relatively rapid and continuous manner. This does not preclude a pump, not shown, from withdrawing warm water in the upper region 16 of the storage vessel 10 via the heating header line 17 to supply it as cooled heating water to the return connection 14. This method of operation also does not preclude heating of the industrial water heat exchanger 18 so that warm industrial water is made available via the header connection 19 at a tap.

The constricted bottom region 13 of the storage vessel 10 also assists the thermo-siphon action through the heat exchanger 8.

A particular advantage of the invention is due to the fact that it can be employed in heating systems with thermostatic valve regulation because as the result of the storage action of the storage vessel the low rate of water circulation resulting from the closure of all thermoplastic valves when the heating requirements on the system are low, have no serious effects.

The invention can also be readily applied to heating systems with mixer control because the slight flow of water through the forced-circulation water heater under conditions of low heat requirements, i.e. with mixer closed, has no effect due to the large storage mass of the vessel.

I claim:

1. A forced circulation water heater comprising a blower burner, a horizontally extending exhaust gas duct, a heat exchanger constructed as a plate block and including upright water tubes disposed in said gas duct, a water circuit connected to said heat exchanger tubes, a storage vessel disposed above said heat exchanger and mounted directly thereon, a common support structurally connecting said storage vessel with said heat exchanger, heating system header connections and return connections extending directly into said storage vessel, said heat exchanger together with its upright water tubes being incorporated into said horizontally extending exhaust gas duct to extend over the entire cross section thereof with said tubes of said heat exchanger being connected to said storage vessel, and including plates in said heat exchanger, said plates being longer in the flow direction of said exhaust gas duct than the effective length of said heat exchanger in the same direction but smaller than the width of said support frame.

2. A forced circulation water heater comprising a blower burner, a horizontally extending exhaust gas duct, a heat exchanger constructed as a plate block and including upright water tubes disposed in said gas duct, a water circuit connected to said heat exchanger tubes, a storage vessel disposed above said heat exchanger and mounted directly thereon, a common support structurally connecting said storage vessel with said heat exchanger, outer connecting ducts provided on the outside of said support frame thereby connecting said heat exchanger on the return side to the bottom region of said storage vessel, a by-pass duct connected to said heat exchanger, the bottom of said heat exchanger communicating with said by-pass duct and said outer connecting ducts, and heating system header connections and return connections extending directly into said storage vessel, said heat exchanger together with its upright water tubes being incorporated into said horizontally extending exhaust gas duct to extend over the entire cross section thereof with said tubes of said heat exchanger being connected to said storage vessel.

3. A forced circulation water heater according to claim 2 wherein the top region of said storage vessel is expanded in relation to the bottom region thereof and wherein an industrial water heat exchanger is provided in the top region of said storage vessel.

4. A forced circulation water heater according to claim 2 including a header of said heat exchanger, said return connection of said heating system being disposed in the bottom region of said storage vessel directly adjacent said header of said heat exchanger.

5. A forced circulation water heater according to claim 2 wherein said heating system return connection is divided into two parallel-connected connecting members which extend to the ends of said outer ducts.

* * * * *